US007331314B2

(12) United States Patent
Osburg et al.

(10) Patent No.: US 7,331,314 B2
(45) Date of Patent: Feb. 19, 2008

(54) TWO-STROKE ENGINE

(75) Inventors: Gerhard Osburg, Kemen (DE); Wolfgang Luithardt, Waiblingen (DE); Peter Schmidt, Waiblingen (DE); Tommy Roitsch, Waiblingen (DE); Michael Joos, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 152 days.

(21) Appl. No.: 11/302,766

(22) Filed: Dec. 14, 2005

(65) Prior Publication Data

US 2006/0180106 A1 Aug. 17, 2006

(30) Foreign Application Priority Data

Dec. 14, 2004 (DE) ..... 10 2004 060 046

(51) Int. Cl.
*F02B 33/04* (2006.01)

(52) U.S. Cl. ..... 123/73 PP; 123/70 V; 123/293

(58) Field of Classification Search ..... 123/73 PP, 123/285, 286, 293, 52.5, 53.5, 59.7, 69 R, 123/70 V
See application file for complete search history.

(56) References Cited

U.S. PATENT DOCUMENTS 5,251,581 A * 10/1993 Takahashi et al. ..... 123/65 P
5,503,119 A * 4/1996 Glover ..... 123/73 B
6,216,650 B1 * 4/2001 Noguchi ..... 123/73 A
6,257,179 B1 * 7/2001 Uenoyama et al. ..... 123/65 R
6,328,288 B1 12/2001 Gerhardy ..... 261/35
6,401,673 B2 * 6/2002 Linsbauer et al. ..... 123/73 PP
6,418,891 B2 * 7/2002 Kobayashi ..... 123/73 PP
6,427,646 B2 8/2002 Galka et al. ..... 123/73 C
6,427,647 B1 8/2002 Galka et al. ..... 123/73 B
6,450,135 B1 9/2002 Araki ..... 123/73 B
6,564,761 B2 * 5/2003 Uenoyama et al. ..... 123/73 PP
6,889,637 B2 * 5/2005 Rosskamp ..... 123/73 PP
2005/0045138 A1 3/2005 Schmidt et al. ..... 123/184.46

FOREIGN PATENT DOCUMENTS

WO 2005/124120 12/2005

* cited by examiner

*Primary Examiner*—Stephen K. Cronin
(74) *Attorney, Agent, or Firm*—Gudrun E. Huckett

(57) ABSTRACT

A two-stroke engine has a cylinder with a combustion chamber that is delimited by a reciprocating piston that drives with a connecting rod a crankshaft rotatably supported in a crankcase. In predetermined positions of the piston, the crankcase is connected by at least one transfer channel to the combustion chamber. The two-stroke engine has a mixture channel for supplying a fuel/air mixture and an air channel that supplies substantially fuel-free air to the transfer channel. In order to provide a simple adjustment of the air channel to different two-stroke engines of a model range, a component in which the air channel is formed has a throttle member that is arranged at an end face of the component. The throttle member throttles the air flow through the air channel in at least one operating state of the two-stroke engine.

17 Claims, 4 Drawing Sheets

TWO-STROKE ENGINE

BACKGROUND OF THE INVENTION

The invention concerns a two-stroke engine, in particular, for a hand-guided working tool such as a motor chainsaw, a cut-off machine or the like. The two-stroke engine comprises a cylinder in which a combustion chamber is disposed that is delimited by a reciprocating piston. The piston drives by means of a connecting rod a crankshaft rotatably supported in a crankcase. The crankcase, in predetermined positions of the piston, is connected by at least one transfer channel to the combustion chamber. The engine further comprises a mixture channel for supplying a fuel/air mixture and an air channel that supplies substantially fuel-free air to the transfer channel.

U.S. Pat. No. 6,450,135 B1 discloses a two-stroke engine that supplies substantially fuel-free air to the transfer channels arranged near the exhaust port. The substantially fuel-free air serves for scavenging the exhaust gas from the combustion chamber. The air that is contained in the transfer channels must be matched to the supplied quantity of fuel/air mixture. The supplied fuel quantity can be adjusted conventionally by means of an adjusting screw of a carburetor. In order to match the supplied air quantity to the operational state of the internal combustion engine, a throttle valve can be provided in the air channel.

The flow cross-section of the air channel is very small in two-stroke engines of small piston displacement. Mounting of the throttle valve is difficult in such a small channel. Since for different two-stroke engines different flow cross-sections of the air channel are required, it is necessary to provide air channels with different flow cross-sections for a cylinder model range with different piston displacements. This requires a significant expenditure in regard to tools for manufacturing the air channels as well as for stockholding the different channels.

SUMMARY OF THE INVENTION

It is an object of the present invention to to provide a two-stroke engine of the aforementioned kind that enables a simple adjustment of the flow cross-section of the air channel.

In accordance with the present invention, this is achieved in that on one end face of a component in which the air channel is formed, a throttle member is arranged that throttles the air flow through the air channel in at least one operating state of the two-stroke engine.

In accordance with the present invention, this is achieved also in that a throttle member embodied as a fixed aperture is arranged in the air channel, wherein the flow cross-section of the aperture is matched to the displacement of the two-stroke engine.

The throttle member enables an adjustment of the air flow through the air channel without having to change the air channel itself. In this way, for all cylinders of a model range the same air channel can be used. Since the throttle member is provided on an end face of a component, it can be mounted on the air channel, or exchanged, in a simple way.

Preferably, the throttle member is arranged at the intake of the air channel. However, it can also be expedient to arrange the throttle member at the outlet of the air channel into the cylinder. The throttle member can be arranged, without having to change the air channel itself, at the intake into the air channel or the outlet from the air channel. However, it can also be provided that the throttle member is arranged between two components that delimit the air channel. In this case, the throttle member can be arranged in a simple way between the two present components that are present without having to change anything on the components that delimit the air channel.

Preferably, the flow cross-section in the throttle member can be variable. It was found that in two-stroke engines that require an adjustment of the flow cross-section the reduction of the flow-cross section is not needed in all operating states. For example, under full load the supply of a large quantity of substantially fuel-free air can be expedient in order to achieve a sufficient scavenging of the combustion chamber and to thus achieve minimal exhaust gas values. When employing a carburetor for supplying fuel, an enrichment of the mixture will result at high engine speed because of the flow conditions. This enrichment can be compensated by supplying a larger amount of air. At low engine speed or when accelerating, the supply of a reduced amount of substantially fuel-free air is required in order to be able to generate a combustible mixture in the combustion chamber. The adjustment of the flow cross-section can be realized in a simple way by adjustment of the flow cross-section of the throttle member.

Preferably, the flow cross-section of the throttle member is mechanically adjustable. However, it can also be expedient for the flow cross-section of the throttle member to be pneumatically adjustable. It is provided that the flow-cross-section of the throttle member is pressure-dependent. The flow cross-section of the throttle member changes accordingly in particular as a function of the pressure in the air channel. The pressure in the air channel is different for different operating states of the two-stroke engine. With increasing engine speed, the vacuum increases, i.e., the pressure is reduced. Accordingly, the vacuum can be used for the adjustment of the flow cross-section of the throttle member. However, the flow cross-section in the throttle member can also be dependent on the engine speed of the two-stroke engine.

It is provided that a throttle element is arranged in the mixture channel. The throttle element is in particular the throttle valve of a carburetor arranged in the mixture channel. The throttle element however can also be configured as a roll-type or barrel-type throttle (throttle barrel). Also, throttle elements of other configurations can be advantageous. Advantageously, the flow cross-section in the throttle member depends on the position of the throttle element in the mixture channel. In particular, the change of the flow cross-section of the throttle member takes place with delay, i.e., is dampened.

It is provided that in the air channel a throttle element is arranged in a component that delimits the air channel. The throttle element in the air channel can be, for example, a throttle valve whose position is coupled to the position of the throttle element in the mixture channel. In the case of a direct coupling of the throttle element in the air channel to the throttle element in the mixture channel, an optimal opening characteristics of the throttle valve in the air channel does not result. At low engine speed the two-stroke engine receives too much substantially fuel-free air while at high engine speed the supplied air is insufficient for proper combustion chamber scavenging. This additional adjustment can be achieved by a throttle member that is arranged upstream or downstream.

Advantageously, the throttle member throttles the air flow through the air channel in idle condition and at low engine speed of the two-stroke engine. Expediently, the throttle member throttles the air flow through the air channel upon accelerating the two-stroke engine. In these operating states the reduction of the flow cross-section by means of a throttle valve arranged in the air channel is not sufficient. The additional throttle member enables in a simple way a further reduction of the supplied air quantity. However, it can also be expedient to arrange the throttle member at the end face of a component delimiting the air channel in the case of an air channel in which no additional throttle element is arranged.

It is provided that the flow cross-section of the air channel is matched to the two-stroke engine by selecting a suitable throttle member. The two-stroke engine of a model range can be configured in accordance with a modular principle wherein the two-stroke engine has air channels that differ only in the selected throttle element. In this way, a model range can be built in a simple way.

A two-stroke engine that enables a simple adaptation of the flow cross-section of the air channel is also achieved by a two-stroke engine comprising a cylinder, in which a combustion chamber is formed that is delimited by a reciprocating piston wherein the piston drives by means of a connecting rod a crank shaft supported rotatably in a crankcase, wherein the crankcase in predetermined positions of the piston is connected by at least one transfer channel to the combustion chamber; comprising a mixture channel for supplying a fuel/air mixture; and comprising an air channel that supplies to the transfer channel substantially fuel-free air, wherein in the air channel a fixed aperture is arranged, wherein the flow cross-section of the aperture is matched to the displacement of the two-stroke engine.

The fixed aperture in the air channel enables an adjustment of the air flow passing through the air channel to the displacement of the two-stroke engine. Accordingly, the air channel itself must not be changed so that for cylinders of a model range with different displacement the same air channel with a different fixed aperture can be used. The aperture can be arranged at any location within the air channel.

Advantageously, the ratio of the flow cross-section of the aperture in square millimeters relative to the displacement of the two-stroke engine in cubic centimeters is smaller than 3.5. It was found that for such a configuration of the flow cross-section of the aperture relative to the displacement of the two-stroke engine an excellent adjustment in regard to the throughput of the two-stroke engine can be achieved.

DESCRIPTION OF THE PREFERRED EMBODIMENTS

Figure 1:
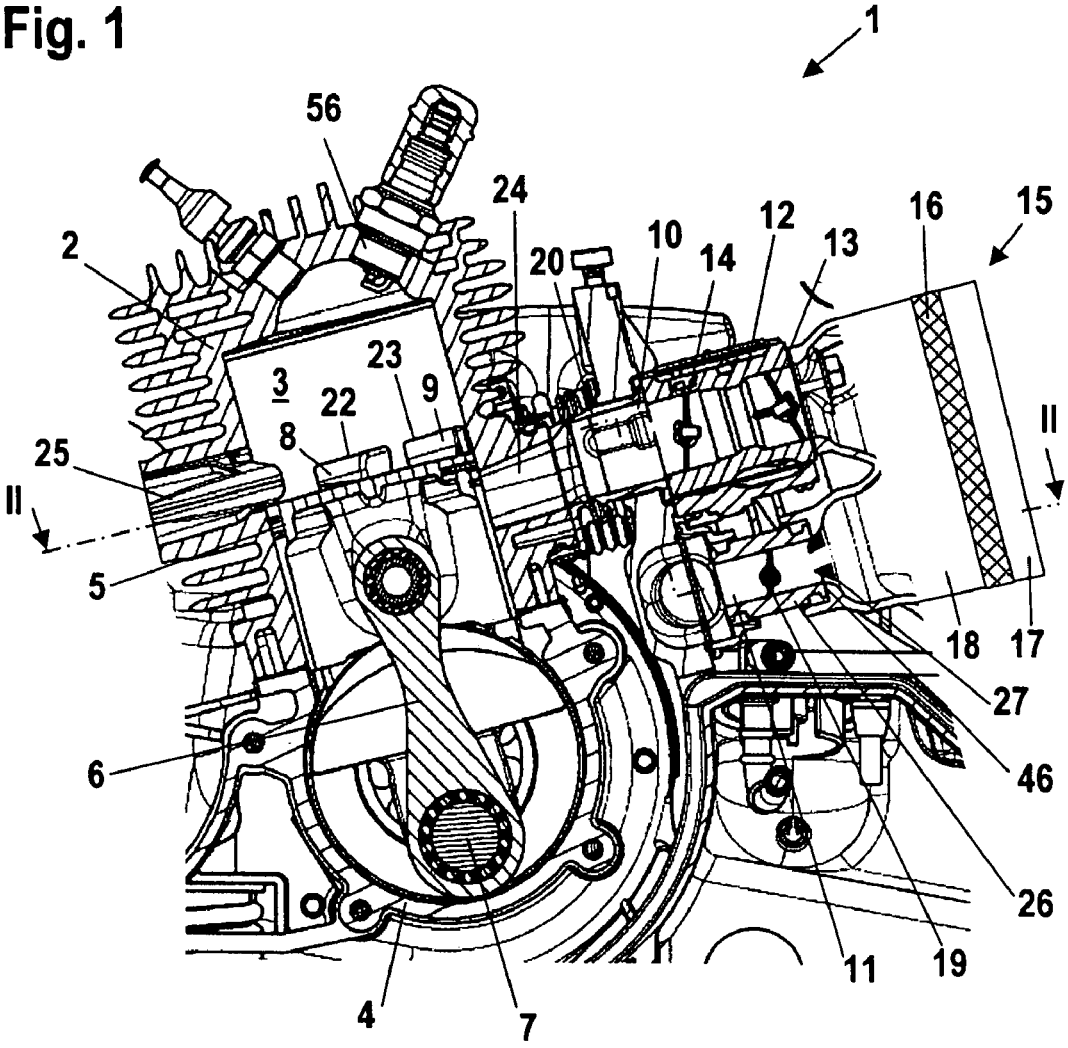
FIG. 1 is a longitudinal section view of a two-stroke engine.
Figure 2:
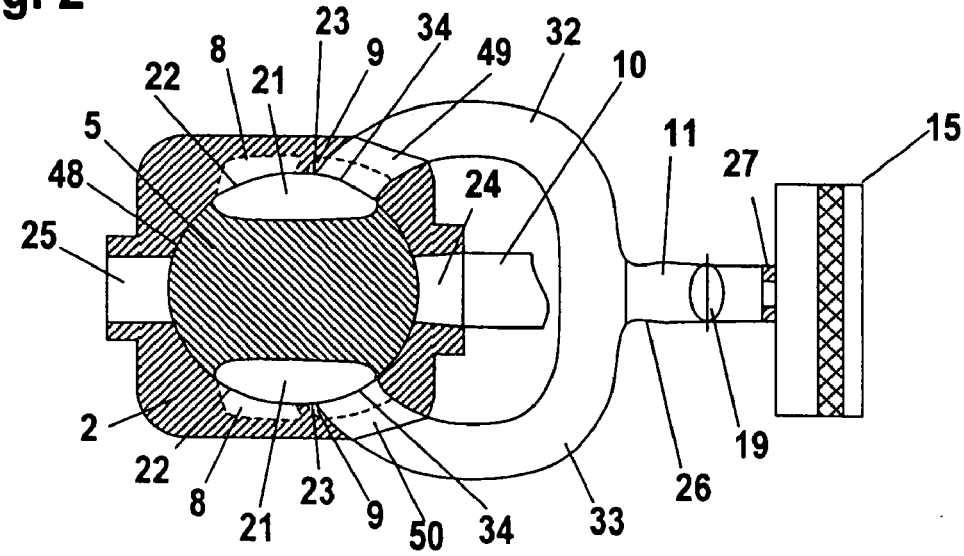
FIG. 2 is a schematic illustration of a section of the two-stroke engine of FIG. 1 along the line II-II.

The two-stroke engine 1 illustrated in FIG. 1 has a cylinder 2 in which a combustion chamber 3 is formed. The combustion chamber 3 is delimited by a piston 5 that drives by means of a connecting rod 6 a crankshaft 7 rotatably supported in a crankcase 4. As also shown in FIG. 2, the two-stroke engine 1 has two opposed transfer channels 8 near the exhaust port that open with transfer ports 22 into the combustion chamber 3. Remote from the exhaust port, two opposed transfer channels 9 are provided that open with transfer ports 23 into the combustion chamber. In the area of the bottom dead center of the piston 5 illustrated in FIG. 1, the transfer channels 8, 9 connect the crankcase 4 to the combustion chamber 3. Exhaust port 25 for exhaust gas leads away from the combustion chamber 3.

The two-stroke engine 1 has a mixture channel 10 that connects an air filter 15 to an intake 24 into the crank case 4. The intake 24 is open in the area of the top dead center of the piston 5. The mixture channel 10 extends within the carburetor 12 and an elastic intake pipe 20. A choke valve 13 and a throttle valve 14 are arranged in the carburetor 12. In the area of the throttle valve 14 fuel ports open into the mixture channel 10 and supply fuel to the air that has been taken in into the mixture channel 10.

The two-stroke engine 1 has an air channel 11 that supplies the transfer channels 8 and 9 with substantially fuel-free air. A section of the air channel 11 is formed within a pipe section 26 in which a throttle valve 19 is pivotably supported. The position of the throttle valve 19 is coupled in particular to the position of the throttle valve 14 in the mixture channel 10. The pipe section 26 extends parallel to the section of the mixture channel 10 that is disposed within the carburetor 12. The pipe section 26 is secured on the carburetor 12 and can be formed as a monolithic part thereof. The mixture channel 10 and the air channel 11 are connected to the clean chamber 18 of the air filter 15. The clean chamber 18 is separated by filter material 16 from the dirt chamber 17 of the air filter 15. On the end face 46 of the pipe section 26 that faces the air filter 15 the throttle member 27 is secured. The throttle member 27 can be secured also in the air filter bottom or between the pipe section 26 and the air filter 15.

FIG. 2 shows that the air channel 11 downstream of the pipe section 26 divides into two branches 32 and 33. Each branch 32, 33 opens via an air channel port 34 at the cylinder bore 48. The air channel ports 34 are advantageously arranged on the side of the transfer port 23 of the transfer channel 9 that is facing the crankcase 4. The piston 5 has two piston recesses 21 that connect the air channel 11 in the area of the top dead center of the piston 5 to the transfer channels 8, 9. The connection is realized via the air channel ports 34, the piston recesses 21, and the transfer ports 22 and 23. As shown in FIG. 2, the sections 49 and 50 of the air channel 11 opening at the air channel ports 34 are formed within the cylinder 2.

In operation of the two-stroke engine 1, fuel/air mixture is sucked in through the intake 24 into the crankcase 4 in the area of the top dead center of the piston 5. Through the air channel 11 and the piston recess 21 the transfer channels 8, 9 are flushed from the side facing the combustion chamber 3 with substantially fuel-free air. Upon downward stroke of the piston 5 the fuel/air mixture is compressed in the crankcase 4. As soon as the transfer channels 8, 9 open toward the combustion chamber 3, the air that is located upstream of the transfer channels 8, 9 flows into the combustion chamber 3 and flushes the exhaust gases within the combustion chamber 3 through the exhaust port 25 out of the combustion chamber 3. The fuel/air mixture that flows into the combustion chamber 3 from the crankcase 4 is compressed in the subsequent upward stroke of the piston 5 within the combustion chamber 3 and ignited in the area of the top dead center by means of the spark plug 56 projecting into the combustion chamber 3. As soon as the exhaust port 25 opens upon subsequent downward movement of the piston 5, the exhaust gases flow out of the combustion chamber 3 and are scavenged out by means of the substantially fuel-free air flowing from the transfer channels 8, 9 into the combustion chamber 3.

The quantity of substantially fuel-free air that is supplied to the transfer channels 8 and 9 depends on the flow cross-section of the air channel 11. By means of the throttle valve 19 the flow cross-section is adjusted to the operating state of the two-stroke engine 1. At low engine speed, the throttle valve 19 is substantially closed so that only a minimal amount of substantially fuel-free air is located upstream within the transfer channels 8 and 9. At full load, the throttle valve 19 is completely open and impairs only minimally the flow cross-section in the air channel 11. In this way, a large quantity of substantially fuel-free air is located upstream of the transfer channels 8 and 9. The throttle member 27 is configured as a fixed aperture. Accordingly, the throttle member 27 reduces the air flow through the air channel 11 in any operating state of the two-stroke engine 1. In this way, the effective flow cross-section of the air channel 11 can be reduced without the air channel 11 itself having to be changed in regard to its configuration.

Figure 3:
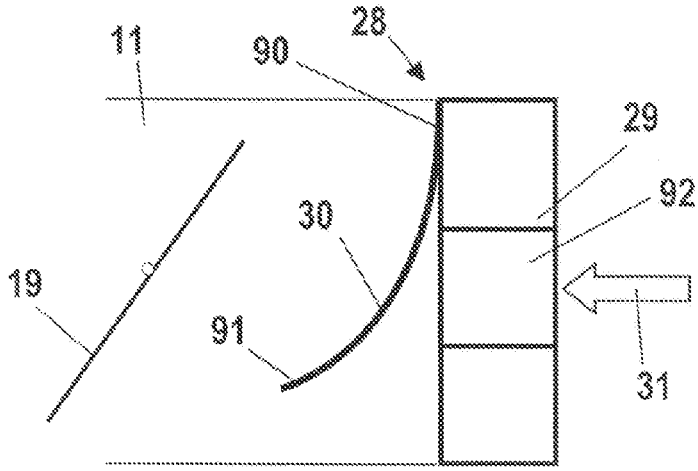
FIG. 3 is a schematic illustration of a first embodiment of a throttle member arranged in an air channel.
Figure 4:
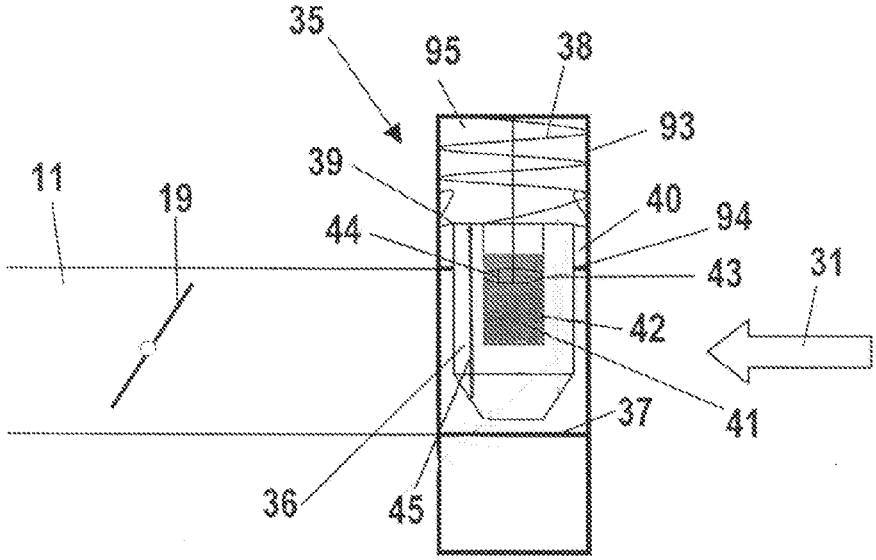
FIG. 4 is a schematic illustration of a second embodiment of a throttle member arranged in an air channel.
Figure 5:
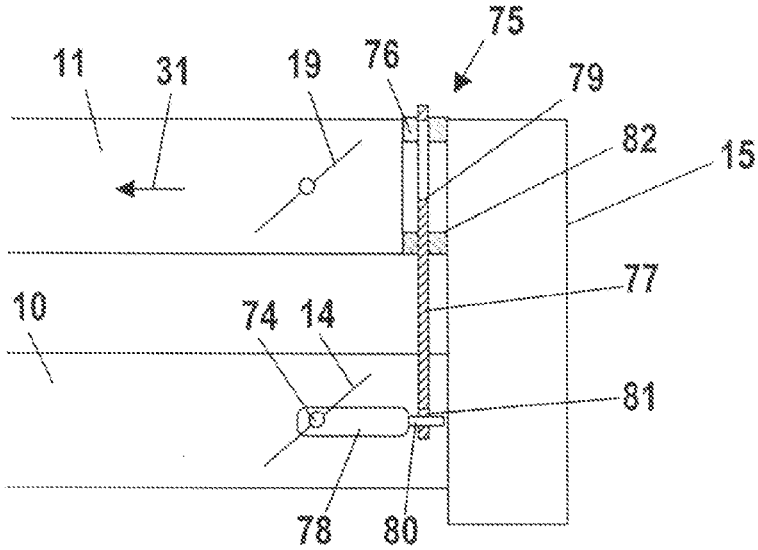
FIG. 5 is a schematic illustration of a third embodiment of a throttle member arranged in an air channel.

Embodiments of throttle members are illustrated in FIGS. 3 to 5. The throttle member 28 illustrated in FIG. 3 has a fixed aperture 29. Relative to the flow direction 31 in the air channel 11, a movable diaphragm 30 is arranged downstream of the fixed aperture 29. The diaphragm 30 has a fixed end 90 with which it is secured to the aperture 29. An opposed free end 91 is movable relative to the aperture 29. The diaphragm 30 is arranged downstream of an opening 92 in the aperture 29. As a function of the air mass flow through the opening 92, the free end 91 is pushed away more or less from the aperture 29. In this way, the diaphragm 30 throttles the air flow in the air channel 11 as a function of the air mass flow through the throttle member 28.

In the throttle member 35 illustrated in FIG. 4, the throttle action is realized as a function of the pressure in the air channel 11. The throttle member 35 has a throttle body 36 that projects into an opening 37 in the throttle member 35. The opening 37 delimits the air channel 11; the flow cross-section of the opening 37 corresponds advantageously to the flow cross-section of the air channel 11. The throttle body 36 is slidably supported in a housing 93 and is seal-tightly guided in a bore 94. By means of a spring 38 the throttle body 36 is spring-loaded into the opening 37. Between the throttle body 36 and the housing 93 an annular chamber 40 is formed in which a predetermined pressure, in particular, ambient pressure, is present. In the housing 93, a chamber 95 is formed in which the spring 39 is arranged. The chamber 95 is separated from the annular chamber 40 by a diaphragm 39. The throttle body 36 is secured on the diaphragm 39. The air channel 11 communicates by means of a compensating bore 45 with the chamber 95. The underpressure that is present in the air channel 11 is transmitted through the compensation bore 45 into the chamber 95. The compensating bore 45 opens into the air channel 11 at the upstream side of the throttle body 36. When the pressure drops in the air channel 11 and thus also within the chamber 95, the force that is exerted by the annular chamber 40 onto the diaphragm 39 increases as a result of the constant pressure in the annular chamber 40. In this way, the throttle body 36 is pulled in the direction toward the chamber 95 away from the opening 37. The throttle body 36 has a cavity 42 in its interior; the cavity is filled with a damping medium 41. A piston 43 that is fixedly secured to the housing 93 projects into the cavity 42; the cavity 42 is movable relative to the piston in the movement direction of the throttle body 36. The piston 43 has a compensation opening 44 between the two ends of the piston 43 and the damping medium 41 flows through the opening upon movement of the piston 43. In this way, the movement of the throttle body 36 is dampened.

With increasing engine speed of the two-stroke engine 1, the under pressure in the air channel 11 increases and the absolute pressure therefore drops. This leads to the throttle body 36 of the throttle member 35 being pulled out of the opening 37 so that the flow cross-section in the air channel 11 increases and the sucked-in air quantity increases. At low engine speed the under pressure in the air channel 11 is minimal so that the throttle body 36 projects far into the opening 37 and greatly reduces the flow cross-section. In this way, it can be ensured that at low engine speed only a minimal quantity of substantially fuel-free air is supplied and that the fuel/air mixture that is introduced into the combustion chamber is sufficiently enriched in order to ensure combustion.

In the case of the throttle member 75 illustrated in FIG. 5, the change of the flow cross-section in the throttle member 75 is realized mechanically. In this case, the change of the flow cross-section is coupled to the position of the throttle valve 14 in the mixture channel 10. For this purpose, a lever 78 is fixedly attached to the throttle shaft 74 of the throttle valve 14. The lever 78 is preferably arranged outside of the mixture channel 10 on the throttle shaft 74. The throttle member 75 has a fixed aperture 76 with an opening 82 that delimits the air channel 11. A slide 77 is movably supported transversely to the flow direction 31 in the air channel 11 in the aperture 76. The slide 77 is preferably arranged perpendicularly to the flow direction 31 in the air channel 11 but it can also be arranged angularly to the flow direction 31 in order to achieve beneficial geometric conditions for its actuation. The slide 77 has a bore 79 that, in the partially open position of the throttle valve 14 illustrated in FIG. 5, is arranged in a staggered position in the mixture channel 10 relative to the opening 82 of the apertures 76 so that the slide 77 reduces the flow cross-section of the opening 82. The lever 78 has a pin 80 that projects into a slotted hole 81 in the slide 77. Upon rotation of the throttle shaft 74, the lever 78 moves the slide 77 by means of the pin 80. Upon further opening of the throttle valve 14, i.e., upon a rotation of the throttle shaft 74 in FIG. 5 in the clockwise direction, the slide 77 is pulled downwardly, the bore 79 is pulled into the opening 82, and the flow cross-section in the throttle member 75 is enlarged. Upon closing of the throttle valve 14, i.e., upon rotation of the throttle shaft 74 in counterclockwise direction in FIG. 5, the opening 79 in the slide 77 is pushed out of the opening 82 so that the flow cross-section in the throttle member 75 is reduced more. In this way, the flow cross-section of the throttle member 75 is coupled to the position of the throttle valve 14 in the mixture channel 10.

Figure 6:
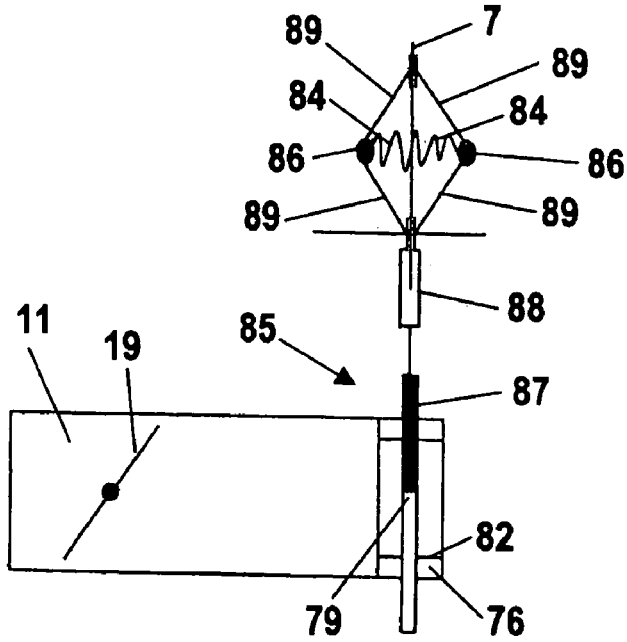
FIG. 6 is a schematic illustration of a fourth embodiment of a throttle member arranged in an air channel.

In the throttle member 85 illustrated in FIG. 6, a slide 87 with an opening 79 projects into the opening 82 of the aperture 76. The slide 87 is secured by a sleeve 88 which is coupled in the longitudinal direction of the slide 87 to the webs 89. Two of the webs 89 secure a body of inertia 86, respectively, that is embodied as a centrifugal member and connected to the crankshaft 7 of the two-stroke engine. As a function of the speed of the crankshaft 7, the body of inertia 86 is deflected more or less outwardly as a result of centrifugal force. By means of the webs 89 the movement of the body of inertia 86 is transmitted onto the sleeve 88. With increasing engine speed, the inertia bodies 86 are accelerated radially outwardly. As a result of this movement, the sleeve 88 is moved in the longitudinal direction of the slide 87 such that the slide 87 is pulled out of the aperture 76. In this way, the flow cross-section of the air channel 11 is reduced to a lesser degree by the slide 87. With dropping engine speed, the bodies of inertia 86 are pulled radially inwardly by means of the springs 84 by which the bodies of inertia 86 are secured on the crankshaft 7. In this way, the sleeve 88 is displaced in the longitudinal direction of the slide 87. The slide 87 is pushed into the opening 82 of the aperture 76 so that the flow cross-section in the air channel 11 is throttled more.

Figure 7:
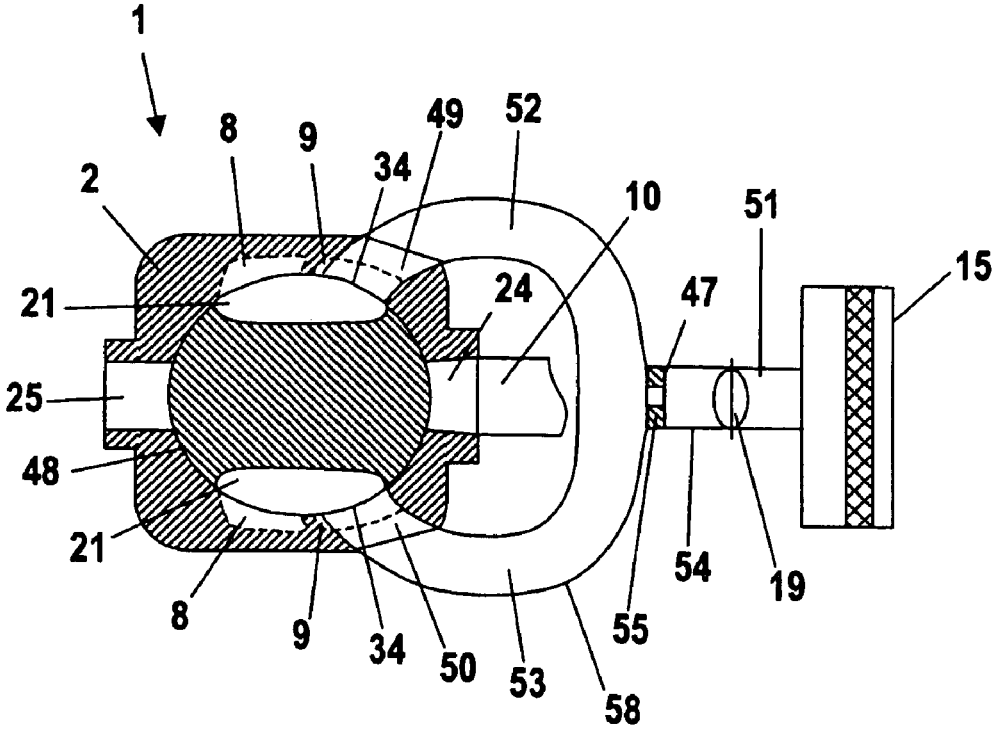
FIG. 7 is a schematic section illustration of a two-stroke engine at the level of the line II-II in FIG. 1 showing a first arrangement of a throttle member.

The two-stroke engine 1 illustrated in FIG. 7 has an air channel 51. The air channel 51 is formed downstream of the air filter within the pipe section 54 in which a throttle valve 19 is pivotably supported. Downstream of the pipe section 54 the air channel 51 divides into two branches 52 and 53 that open via an air channel port 34 at the cylinder bore 48, respectively. The two branches 52 and 53 are formed within a channel section 58. A throttle member 55 is arranged in the air channel 51 for reducing the flow cross-section. The throttle member 55 is arranged at the downstream end face 47 of the pipe section 54 between the pipe section 54 and the channel section 58. The throttle member 55 can be configured as a fixed aperture. However, the flow cross-section of the throttle member 55 can also be variable. For example, throttle members can be used that are embodied as disclosed in FIGS. 3 to 6.

Figure 8:
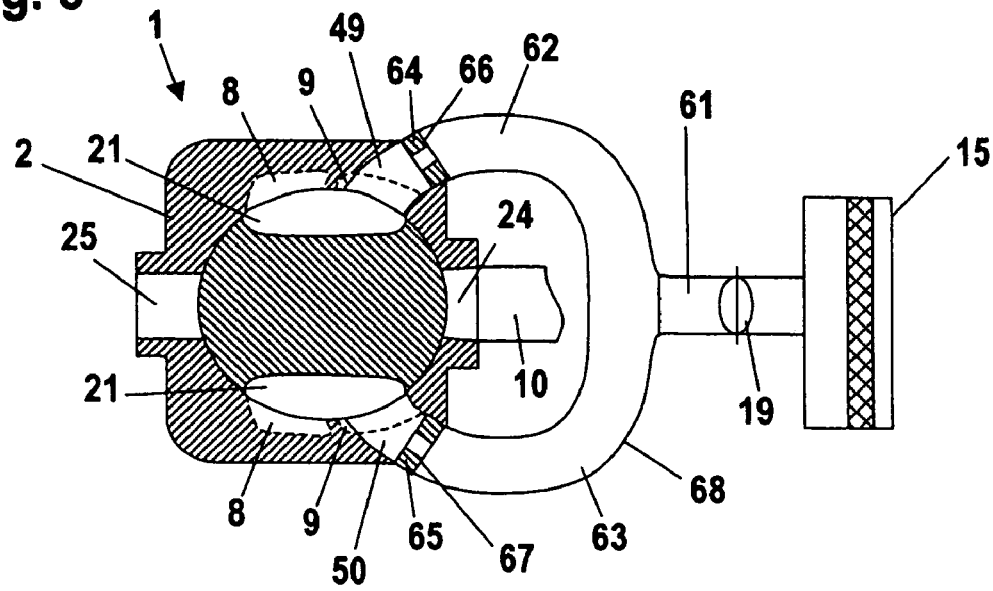
FIG. 8 is a schematic section illustration of a two-stroke engine at the level of the line II-II in FIG. 1 showing a second arrangement of a throttle member.

The two-stroke engine 1 illustrated in FIG. 8 has an air channel 61 that divides into two branches 62 and 63. The two branches 62 and 63 are formed in a channel section 68. The branch 62 is secured with its end face 66 on the cylinder 2 and the branch 63 with the end face 67. A throttle member 64, 65 is secured to the end faces 66 and 67, respectively, that reduces the flow cross-section of the air channel 61. The throttle member 64 is arranged between the branch 62 and the section 49 of the air channel 61 formed within the cylinder 2. The throttle member 65 is arranged between the branch 63 and the section 50 of the air channel 61 formed in the cylinder 2. The throttle member 64 and 65 are embodied as fixed apertures. However, throttle members with variable flow cross-section, for example, those of FIGS. 3 to 6, can be used also.

Figure 9:
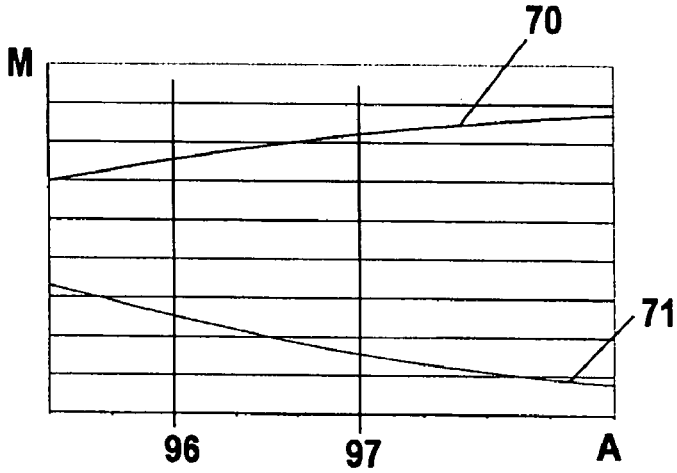
FIG. 9 shows a diagram that indicates the total throughput and fuel/air mixture throughput through the two-stroke engine as a function of the cross-sectional surface area of the throttle member.
Figure 10:
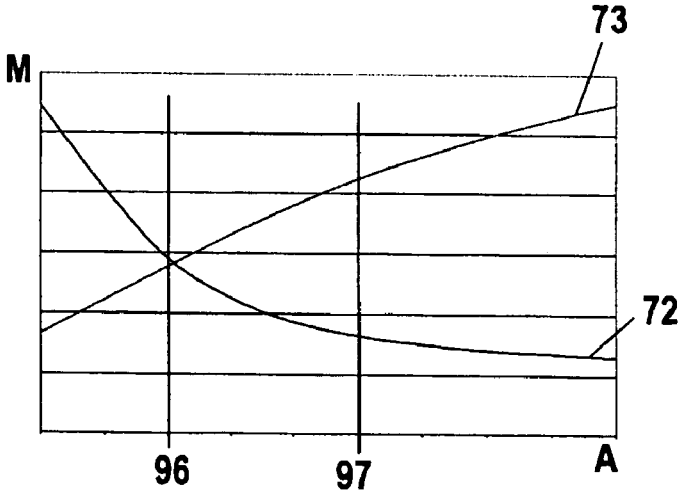
FIG. 10 shows a diagram that indicates the air throughput and the fuel throughput through the two-stroke engine as a function of the cross-sectional surface area of the throttle member.

FIGS. 9 and 10 show diagrams that illustrate the throughput M through the internal combustion engine as a function of the flow cross-section A of a throttle member in the air channel 11, 51, 61. Both diagrams show in this connection the throughput M at a fixed engine speed of the two-stroke engine 1. The throughput M is illustrated in both diagrams as a function of the flow cross-section A of an aperture.

The curve 70 in FIG. 9 shows the total throughput of air and fuel/air mixture through the two-stroke engine. With increasing flow cross-section A, the total throughput increases. The curve 71 illustrates the mixture throughput through the two-stroke engine 1. The latter drops with increasing flow cross-section A of the throttle member. In order to be able to achieve a certain output of the two-stroke engine 1, the total throughput illustrated in curve 70 through the engine cannot decrease arbitrarily. A minimum throughput must be ensured. For this reason, the flow cross-section A through the throttle member cannot be selected to be arbitrarily small. At the same time, a sufficient supply of fuel to the two-stroke engine must be ensured. A high throughput of fuel/air mixture, illustrated by curve 71, is however achieved by reduced flow cross-sections A. When arranging a throttle member 27 that is configured as a fixed aperture in the air channel 11, the flow cross-section A represents an optimal value for these two requirements. In order to ensure a predetermined output of the two-stroke engine 1 and at the same time a satisfactory fuel supply, the ratio of flow cross-section A of the aperture in square millimeters relative to the displacement of the two-stroke engine 1 in cubic centimeters is less than 3.5. Advantageously, the ratio is 0.9 to 3.5, expediently 0.9 to 2.5, and, in particular, 2.1 to 3.2. Preferably, the ratio of the flow cross-section A in square millimeters to the displacement of the two-stroke engine in cubic centimeters is within a range of 2.1 to 3.2. The flow cross-section A is advantageously between a minimal flow cross-section 96 and a maximum flow cross-section 97 shown in the diagram in FIG. 9.

As shown in FIG. 10, the pure air throughput that is illustrated by curve 73 increases with increasing flow cross-section A of the aperture. When arranging a throttle member 27 that is configured as a fixed aperture in the pure air channel, it must be taken into account that the flow cross-section A of the aperture is sufficiently large so that the air located upstream in the transfer channels is sufficient for separating exhaust gases and the mixture that flows in from the crankcase. As illustrated in curve 72, the fuel throughput through the aperture initially drops greatly and subsequently only weakly with increasing flow cross-section A. In order to achieve also at low engine speed a still sufficient enrichment of the fuel/air mixture, a certain fuel quantity must be supplied to the two-stroke engine. In order to achieve a sufficient enrichment as well as adequate scavenging action, in the arrangement of a fixed aperture in the air channel it is necessary to adjust the flow cross-section A of the aperture relative to the displacement of the two-stroke engine. It was found that the ratio of the flow cross-section A of the aperture in square millimeters to the displacement of the two-stroke engine 1 in cubic centimeters should be smaller than 3.5. In particular, the ratio should be 0.9 to 3.5, advantageously 0.9 to 3.2. The ratio is preferably 2.1 to 3.2.

In FIGS. 9 and 10, an advantageous minimal flow cross-section 96 and an advantageous maximum flow cross-section 97 for the flow cross-section A of the aperture is indicated, respectively. These flow cross-sections are dependent on the displacement of the two-stroke engine, respectively. The displacement of the two-stroke engine 1 is the volume that is displaced by the piston 5 upon movement between the bottom dead center and the top dead center.

This application incorporates by reference the entire disclosure of German priority application 10 2004 060 046.5 filed Dec. 14, 2004.

While specific embodiments of the invention have been shown and described in detail to illustrate the inventive principles, it will be understood that the invention may be embodied otherwise without departing from such principles.

What is claimed is:

1. A two-stroke engine comprising:

a cylinder having a combustion chamber;

a reciprocating piston arranged in the cylinder and delimiting the combustion chamber;

a connecting rod connected to the piston;

a crankshaft rotatably supported in a crankcase, wherein the piston drives with the connecting rod the crank shaft;

at least one transfer channel connecting in predetermined positions of the piston the crankcase to the combustion chamber;

a mixture channel supplying a fuel/air mixture to the combustion chamber;

an air channel supplying substantially fuel-free air to the at least one transfer channel;

a first throttle member arranged on an end face of a first component in which the air channel is formed, wherein the first throttle member throttles the air flowthrough the air channel in at least one operating state of the two-stroke engine;

wherein the first throttle member is arranged on the end face of said first component such that the first throttle member is located at an inlet of the air channel, or at an outlet of the air channel, or between said first component and a second component of the air channel;

wherein a flow cross-section of the air channel is matched to the two-stroke engine by selecting an appropriate configuration of the first throttle member.

2. The two-stroke engine according to claim 1, wherein the first throttle member is a fixed aperture.

3. The two-stroke engine according to claim 1, further comprising a second throttle member within the air channel, wherein the second throttle member is arranged in a component delimiting the air channel.

4. The two-stroke engine according to claim 1, wherein the first throttle member throttles the air flowthrough the air channel in idle condition, at low engine speed, and during acceleration of the two-stroke engine.

5. The two-stroke engine according to claim 1, wherein the piston has at least one piston recess that connects the air channel to the at least one transfer channel.

6. The two-stroke engine according to claim 1, wherein the first throttle member has a flow cross-section that is variable.

7. The two-stroke engine according to claim 6, wherein the flow cross-section of the first throttle member is mechanically adjustable.

8. The two-stroke engine according to claim 6, wherein the flow cross-section of the first throttle member is pneumatically adjustable.

9. The two-stroke engine according to claim 6, wherein the flow cross-section of the first throttle member is pressure-dependent, wherein the flow cross-section of the first throttle member changes as a function of a pressure present in the air channel.

10. The two-stroke engine according to claim 6, wherein the flow cross-section of the first throttle member depends on an air mass flow through the first throttle member.

11. The two-stroke engine according to claim 6, wherein the flow cross-section of the first throttle member depends on an engine speed of the two-stroke engine.

12. The two-stroke engine according to claim 6, further comprising a throttle element arranged in the mixture channel, wherein the flow cross-section of the first throttle member depends on a position of the throttle element in the mixture channel.

13. The two-stroke engine according to claim 6, wherein a change of the flow cross-section of the first throttle member takes place with delay caused by a dampening action of the first throttle member.

14. A two-stroke engine comprising:

a cylinder having a combustion chamber;

a reciprocating piston arranged in the cylinder and delimiting the combustion chamber;

a connecting rod connected to the piston;

a crankshaft rotatably supported in a crankcase, wherein the piston drives with the connecting rod the crank shaft;

at least one transfer channel connecting in predetermined positions of the piston the crankcase to the combustion chamber;

a mixture channel supplying a fuel/air mixture to the combustion chamber;

an air channel supplying substantially fuel-free air to the at least one transfer channel;

a fixed aperture arranged in the air channel; wherein a flow cross-section of the aperture is matched to a displacement of the two-stroke engine.

15. The two-stroke engine according to claim 14, wherein a ratio of the flow cross-section of the aperture in square millimeters relative to the displacement of the two-stroke engine in cubic centimeters is smaller than 3.5.

16. The two-stroke engine according to claim 15, wherein the ratio of the flow cross-section of the aperture in square millimeters relative to a displacement of the two-stroke engine in cubic centimeters is 0.9 to 3.5.

17. A two-stroke engine comprising:

a cylinder having a combustion chamber;

a reciprocating piston arranged in the cylinder and delimiting the combustion chamber;

a connecting rod connected to the piston;

a crankshaft rotatably supported in a crankcase, wherein the piston drives with the connecting rod the crank shaft;

at least one transfer channel connecting in predetermined positions of the piston the crankcase to the combustion chamber;

a mixture channel supplying a fuel/air mixture to the combustion chamber;

an air channel supplying substantially fuel-free air to the at least one transfer channel;

a first throttle member arranged on an end face of a first component in which the air channel is formed, wherein the first throttle member throttles the airflow through the air channel in at least one operating state of the two-stroke engine;

wherein the first throttle member is arranged on the end face of said first component such that the first throttle member is located at an inlet of the air channel, or at an outlet of the air channel, or between said first component and a second component of the air channel;

wherein a flow cross-section of the first throttle member is controlled by the engine speed of the two-stroke engine.

* * * * *